United States Patent [19]

Hartlage

[11] Patent Number: 4,505,173

[45] Date of Patent: Mar. 19, 1985

[54] THREE-KNIFE CUTTING MACHINE

[75] Inventor: Jürgen Hartlage, Langenhagen, Fed. Rep. of Germany

[73] Assignee: H. Wohlenberg KG GmbH & Co., Hanover, Fed. Rep. of Germany

[21] Appl. No.: 463,395

[22] Filed: Feb. 3, 1983

[30] Foreign Application Priority Data

Feb. 5, 1982 [DE] Fed. Rep. of Germany ..... 3204280
Jan. 27, 1983 [DE] Fed. Rep. of Germany ..... 3302946

[51] Int. Cl.[3] ..... B26D 7/06; B26D 7/02; B26D 1/03

[52] U.S. Cl. ..... 83/112; 83/104; 83/153; 83/268; 83/278; 83/925 A

[58] Field of Search ..... 83/925 A, 277, 278, 83/268, 269, 81, 82, 112, 151, 153, 104, 157, 281

[56] References Cited

U.S. PATENT DOCUMENTS

Re. 28,840 6/1976 Sarring ..... 83/925 A
3,732,766 5/1976 McCain ..... 83/104

FOREIGN PATENT DOCUMENTS 1963861 3/1975 Fed. Rep. of Germany .
3201836 9/1978 Fed. Rep. of Germany .

*Primary Examiner*—James M. Meister

*Attorney, Agent, or Firm*—Manfred M. Warren; Robert B. Chickering; Glen R. Grunewald

[57] ABSTRACT

The invention concerns a three-knife cutting machine, in which dogs on a conveying chain in machine tempo transport the material to be cut from a magazine and into a transfer station, in which pushers moveable in the direction of transport take over the material to be cut and transport it up against stops in the cutting station, in which besides two back stops two stops for the head and foot sides of the delivered cutting material are provided, whereby the stops are moveable in machine tempo back into the transfer station and again into the cutting station and, for transport of the cut material from the cutting station, further stops are located before the first stops in the direction of transport and capable of moving together with the latter, the further stops being located at such a distance from the first stops that the further stops assume a carrying position in the cutting station for the cut material which is lying there when the first stops are located in the transfer station, and whereby all stops can be moved at right angles to the direction of transport out of the way of the material being cut and back. In this manner, the material being cut remains exactly aligned, even at high working speeds, is moved with care and the constructive design is simplified.

5 Claims, 2 Drawing Figures

THREE-KNIFE CUTTING MACHINE

Figure 1:
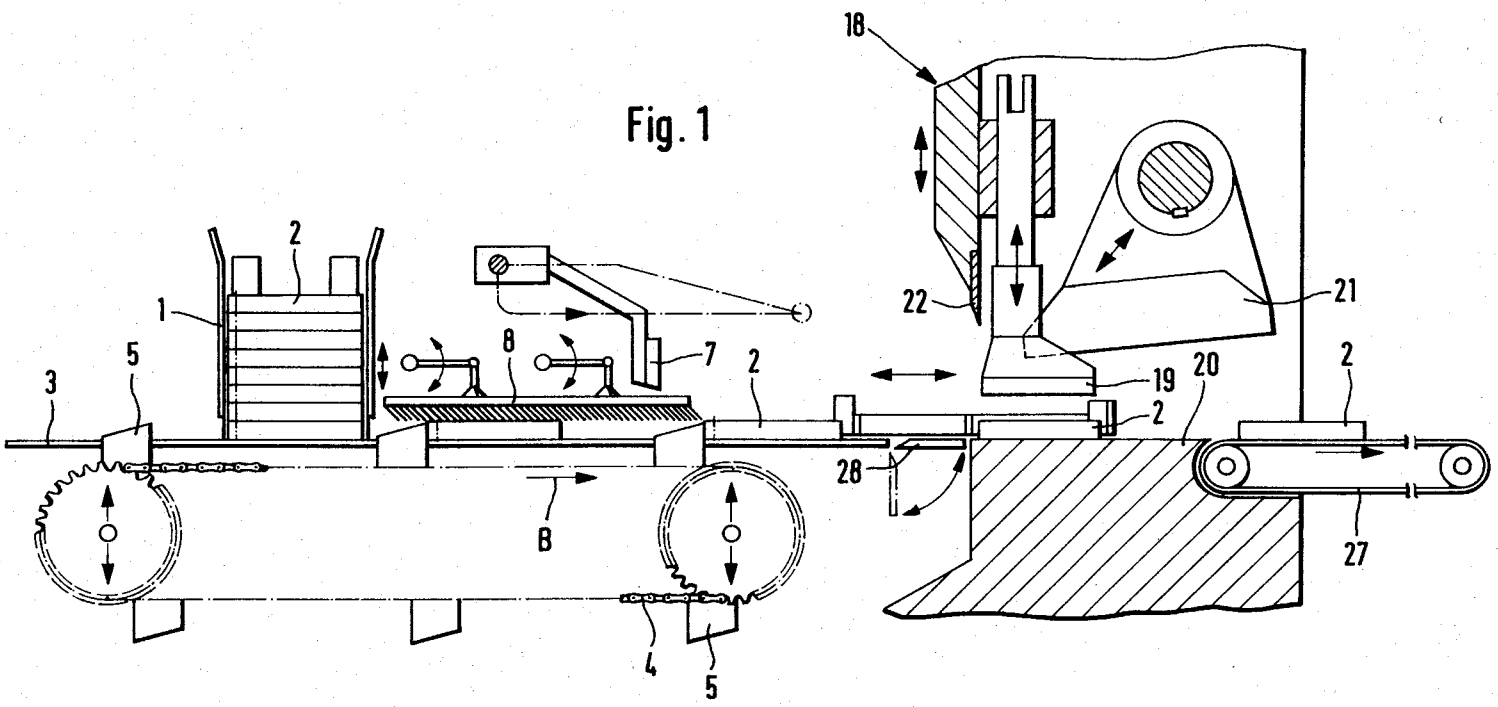

Three-knife cutting machines for the three-sided cutting of stacks of books, brochures or the like are well known, the material to be cut being automatically brought to the cutting table, aligned there under the knives and held down on the cutting table by a pressure plate. The two side knives are immediately operated at the same time, in order to trim the head and foot of the stack, and then in a second work operation the front knife cuts the front of the stack, whereupon the cut material is automatically removed from the cutting table and leaves the machine by means of a conveyor belt.

This cutting sequence, which can also be reversed, is necessary because the side and front knives have to be longer than the material to be cut and therefore would be in each other's way in the case of simultaneous motion.

Three-knife cutting machines are frequently used in book production lines, which have a high production rate and correspondingly require a high work tempo of the three-knife cutting machine. This means, in a single work cycle, that not only must the side knives and the front knife be operated one after the other, but that the knives also must remain for a certain length of time above the cutting area, so that in this length of time the material to be cut can be transported into the cutting station, aligned there and transported out of the cutting station after the cut.

In DE-PS No. 19 63 861 and in the older patent application No. P 32 01 836.3 of the applicant there are descriptions of three-knife cutting machines, in which the knife movements are derived from the so-called single-revolution shaft of the machine, whereby the drive mechanism for the knife holders consists of a series arrangement of guide unit, which operates the knife, and functional unit, which precedes the other. The guide unit raises and lowers the attached knife assembly, while the functional unit controls the time of operation of the guide unit according to a given function, which also includes the brief pause of the knives.

When such machines are put into high-performance production lines, the problem lies in the fact that the period in which the knives are at rest, in which the material to be cut must be transported to the cutting station, is very short, and despite that it is necessary exactly to position the material in the cutting station for an exact cut while simultaneously protecting the material from damage.

As a rule cutting machines contain a magazine, which accepts the material to be cut which one finds in, let us say, a production line. In the case of a familiar machine, the material to be cut is pushed out of this magazine back first synchronically to the tempo of the machine by means of a conveying chain provided with dogs, and conveyed to a transfer station, from where the material to be cut is brought to a cutting station by pushers, in which station fixed stops receive the material to be cut, whereby the material is simultaneously positioned for the cut. In this position in the cutting station, the material being cut is pressed down onto the cutting table by the pressure plate, and following that the front, head and foot cuts are made, while the pushers return to their original position.

Removal of the material from the cutting station is accomplished by transport belts which grip the material from above and below and push the cut material out of the cutting station onto an off-feed conveyor belt.

In the case of another familiar three-knife cutting machine, the material to be cut is transported head first to a corner station. There it is aligned and gripped above and below by intake pincers. These intake pincers bring the material to be cut into the cutting station, with the front side first. After cutting, the material is moved to an off-feed conveyor belt by grippers which swing in from the sides.

The first-named machine with magazine feed has a series of disadvantages. When the material to be cut is pushed from the transfer station into the cutting station, the material to be cut can become misaligned, and it is problematic to allow the material to wait until there is a pause in the cutting station, so that the material to be cut slams against the back stops in the cutting station. This makes exact alignment before the pressure plate comes down a more difficult affair, whereby the accuracy of the cut is diminished and the delicate back of the book can be damaged.

Removal of the stack of material cut, after cutting is accomplished, by means of belts or spring-loaded rollers which grasp only the top and bottom copies of the material, cannot prevent shifting of the remaining copies in the stack at high speeds. However, an exactly positioned stack is absolutely necessary for other machines that follow, e.g. for counting, binding, packing, etc.

Delivery of the material to be cut to the cutting station with advance corner station by means of intake pincers requires periods of rest in the individual stations. With three-knife cutting machines having more than one stroke per second, this can lead to disruptions in the flow of production. Transport from the corner station to the cutting station by means of the pincer cart implies long travel distances at high speeds, since the delivery of the material to be cut must take place outside the operating area of the cutting station.

The invention is based on a three-knife cutting machine with a magazine to accept material to be cut, in the form of books, brochures, and the like, such as is found in a production line, with a conveying chain provided with dogs to push the material to be cut out of the magazine into a transfer station in machine tempo, either one piece at a time or in stacks, with pushers which move back and forth in the direction of the chain to deliver the cutting material from the transfer station to back stops in a single cutting station, in which sequentially either first the head and foot cuts are made by means of the side knives and then the front cut by means of the front knife, or vice versa, and with means of removing the material cut from the cutting station after the cut.

The object of the invention is to create a three-knife cutting machine of the above-described type, which provides for exact positioning of the material to be cut for an exact cut while preventing damage to the material being cut, even with very high work speeds.

This object is attained in the invention by providing in the cutting station first stops in the form of two back stops and two side stops at right angles to these to adjoin the head and foot sides of the delivered cutting material, by making these first stops moveable in machine tempo back into the transfer station and again into the cutting station, by making the means of removal of the cutting material from the cutting station consist of at least two further stops, which come before the first stops in the direction of feed, move together with them, and are located at such a distance from them that the further stops in the cutting station assume a carrying position for the cutting material which lies there when the first stops are located in the transfer station, by providing that all stops can be moved at right angles to the direction of feed out of the way of the material to be cut, before their movement in the direction of the transfer station begins, and by providing that they can be moved back into the path of the cutting material, when their movement in the direction of the transfer station has ended.

The invention achieves the result that the material to be cut is held on four sides as it is delivered to the cutting station, that is, on the one hand by means of the pushers on the front side and on the other hand by means of the back stops as well as by means of the stops for the head and foot sides located at right angles to the latter, so that mutual shifting of the individual units of the material being cut is prevented, even when there are several units in the stack. By means of the fact that the stops can be slid into the transfer station, the material being cut can, on the one hand, be brought up to them gently by the pushers, and on the other hand when the stops return to the cutting station, a gentle braking action leading to a complete stop can afterwards be effected. An additional very significant advantage arises from the fact that the further stops are moved synchronous with the first stops, so that at the same time a stack of material to be cut is introduced into the cutting station, the cut stack is being removed from it. This leads to a considerable simplification in construction.

Preferably, there are six further stops, of which in the carrying position in the cutting station two are oriented toward the frontside, two toward the back and one each toward the head and foot sides of the material being cut.

In this case, the stops oriented toward the back and the head side, and the stops oriented toward the back and the foot side of the material being cut, border each other.

Preferably, those stops which are located on one side of the transport path of the material being cut are located on one common carrier each, which moves in the plane of the transport path along a closed rectilinear path, whereby the movements of the two carriers at right angles to the path of transport occur in opposite directions. This means of control provides that the stops, which locate the corners of the material being cut, move out of the way of the material which is being cut after their guide task has ended, so that they can be moved back toward the transfer station, past the stack of cutting material which has just been introduced into the cutting station.

It is advantageous if the movements of the pushers and carriers of the stops are so coordinated with one another that the pushers, after grasping the cutting material, initially move more quickly than the carriers of the stops, and that the pushers, having brought up the cutting material to the first stops, continue moving synchronous with the carriers of the stops, until the cutting material reaches the cutting station. This ensures shock-free transport and braking of the cutting material along practically the entire transport path.

Figure 2:
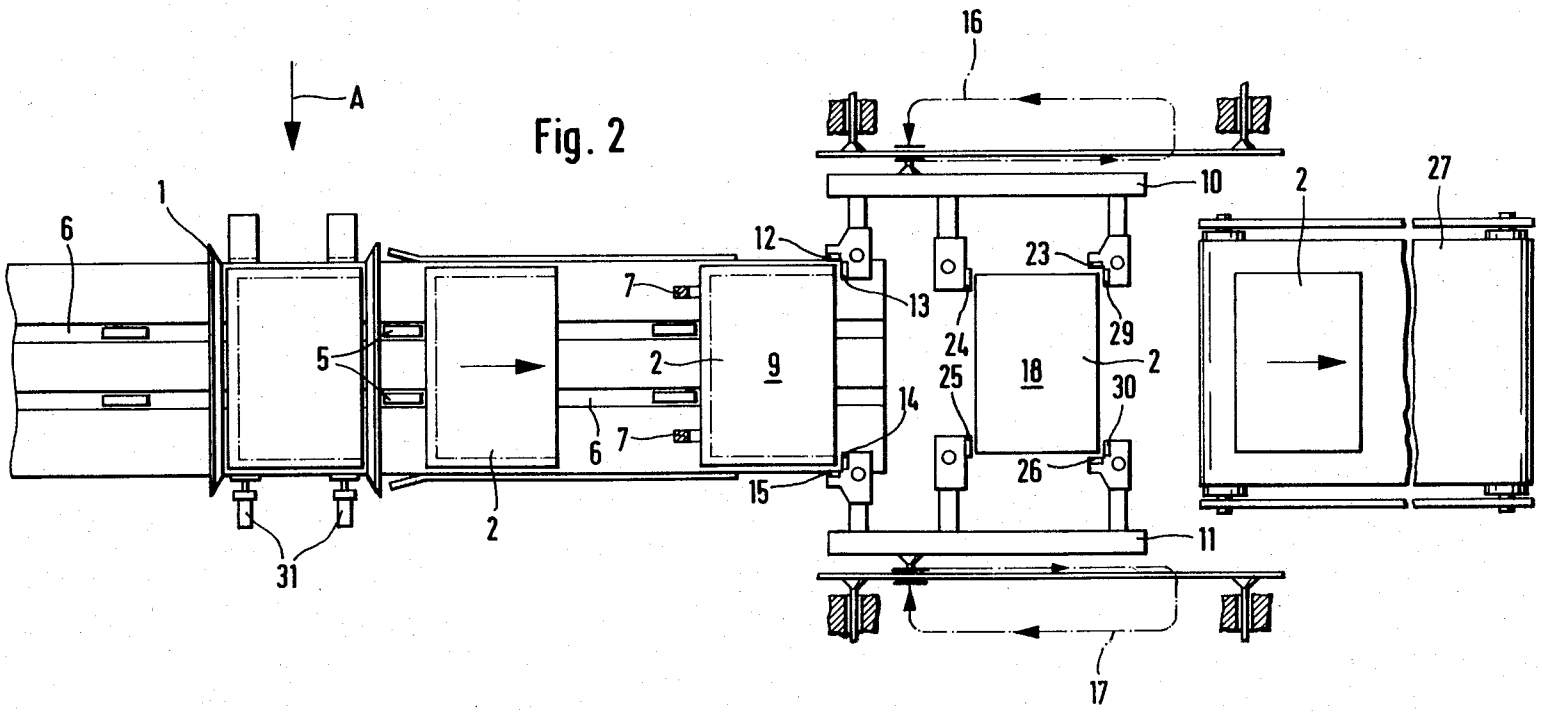

In the following, the invention is more closely clarified with regard to a three-knife cutting machine shown schematically in the drawings. In the drawings, FIG. 1 shows the cutting machine in elevation and FIG. 2 shows the cutting machine in plan.

A magazine 1 serves to accept the products found in a production line, e.g. books 2. These books are, by way of example, conveyed into the magazine 1 from above in the direction of the arrow A, so that they form a stack in it, whereby the lowest book lies on a table 3. In high performance production lines, the books enter the magazine at high speed and must be braked there to zero speed. This is usually done with rigid striker plates, which are, however, not capable of absorbing the energy of impact of the books, so that the latter recoil from the striker plates. This leads to errors in stack formation and in some cases to upright positioning of the books, whereby the entire process is disturbed and the machine operator must intervene manually to relieve the disruption. Such disruptions are prevented in the case of the illustrated embodiment of the three-knife cutting machine by making the striker plates not rigid but like shock absorbers, which absorb the energy of impact of the arriving book, so that, on the one hand, perfect stacking of the books is ensured and, on the other hand, damage to the books on impact is avoided.

Below the table 3 is located a continuous chain 4 driven in the direction of the arrow B, on which are located at equal intervals from each other dogs 5, which project upward through slots 6 in the table 3, whereby the chain drive wheels and thereby the dogs 5 are adjustable in height.

In the illustrated embodiment it is assumed that always just one book at a time is to be worked on, but in practice, of course, stacks of several books or brochures can be removed from the magazine 1 as well to be worked on. The height adjustment of the entire conveying chain assembly and thus of the dogs 5 allows adjustment of the extent to which the dogs project above the table 3, and of the height to which cutting material is to be removed from the magazine 1. The books remaining in the magazine are restrained by a pusher which is adjustable in height. In contrast to the familiar adjustment by means of adjusting the height of the table, the adjustment of the conveying chain assembly has the advantage that no height differences in the path of transport can arise. The feed of books 2 into the magazine 1 occurs in such manner that the back of the books 2 is turned away from the dogs 5 and thus the dogs contact the less sensitive front of the book. In this manner books 2 are continuously started on their way. The distance between the dogs 5 and their lengths are so determined that even in the case of slippage of the following books a gap always remains, which the front pushers 7 can enter from above. A brush arrangement 8 or the like opposes possible shifting of the books 2. The front pushers 7 carry out the movement shown by the dashed and dotted line in FIG. 1, whereby the initial position is illustrated in FIG. 1. As soon as the dogs 5 dip away to change direction and thus can no longer transport the book they have moved, the front pushers take over further conveyance of the book in a transfer station 9. Before the front pushers 7 become effective, four stops 12, 13, 14, 15 have moved into the transfer station 9 against the path of transport of the book. Two each of these stops are located on a carrier 10 or 11, whereby the stops 13 and 14 are intended to adjoin the back of the book and the stops 12 and 15 are intended to adjoin the head or foot of the book 2. The carriers 10 and 11 each carry out a closed rectilinear movement in the plane of the transport path, which movement is indicated in FIG. 2 by means of the dotted and dashed lines 16 and 17. In the end position of the carriers 10 and 11 shown in FIG. 2, the stops 12 to 15 still have a certain distance from the book 2 and are beginning with the motion of the front pusher 7 a movement running in the same direction to the cutting station 18, whereby the book 2 is transported over a removable bridge 28. The movements of the front pushers and the carriers 10 and 11 are so correlated that the front pushers 7 initially move faster, until the book 2 comes to lie against the stops 12 to 15, while following that the movements of the front pushers 7 and the carriers 10 and 11 are synchronous, until the book arrives in the cutting station 18. During this entire movement from the transfer station 9 to the cutting station 18, the book 2 is held in place on all sides by the stops 12 to 15 on the one hand and the front pushers on the other hand, until it comes to rest in the cutting station 18. Such shaped means of holding the book or stack of books ensures constantly exact alignment in the cutting station and provides that the book is exposed to no harsh movements or local pressures. After the book 2 has reached the cutting station 18, the pressure plate 19 is moved down and presses the book 2 or, as the case may be, a stack of several units in its aligned position firmly down onto the cutting table 20, so that now the threesided cut by means of the two side knives 21 and the front knife 22 can be accomplished. The front pushers 7 return to the initial position illustrated in FIG. 1, and also the carriers 10 and 11 return to the transfer station 9, after they first carry out opposed movements away from one another, by means of which the stops 12 to 15 are moved out of the transport path of the books, so that they travel past the book located in the cutting station on the outside and stay out of the way of the cutting of head, front, and foot sides.

On the carriers 10 and 11 are located further stops 24, 25, 23, 26, 29, 30. These stops are located before the stops 12 to 15 in the direction of transport of the books 2, and at such a distance from them that the further stops assume a carrying position in the cutting station 18 for the cutting material lying there, when the stops 12 to 15 are located in the transfer station 9. Stops 24 and 25 lie on the front side of the trimmed book 2 and stops 29 and 30 lie on the back of it, while stops 23 and 26 lie on the head and foot sides of the trimmed book and border the stops 29 and 30. When after a completed cut the pressure plate 19 has moved up and a new book is being brought in by the front pushers 7, the stops 23, 24, 25, 26, 29, 30 push the trimmed book out of the cutting station during this movement, until the book reaches the off-feed conveyor belt and from there is delivered to a following production process.

It is efficient to design the stops in such manner that they practically locate the corners of the books. This allows the displacement of the carriers 10 and 11 across the direction of transport to be kept small. Of course, all the stops are adjustable, so that they can be made to suit the format of the particular material being cut.

It can be seen from the description above that the design and control of the stop system of the invention permits an extraordinarily quiet and harmonious sequence of movements, so that even at the high speeds of modern high performance production lines, the material to be cut is handled with care and remains exactly aligned, whereby in addition a considerable simplification in construction is attained, because additional means of removal of the trimmed material and control means necessary for that may be omitted.

What is claimed is:

1. In a three knife cutting machine for stacked paper including a conveying means provided with dogs to push paper into a transfer station and pushers moving back and forth in the direction of movement of the conveyor to deliver paper from the transfer station to a position against back stops in a cutting station in which side cuts are made by side knives and a head cut is made by a head knife and including means for removing paper from the cutting station, the improvement comprising:

first stops including back stops (13–14) and side stops (12–15) at right angles to said back stops, the first stops being moveable in machine tempo back and forth between a transfer station (9) and a cutting station (18), second stops (24–25) moveable back and forth in the direction of travel of the conveyor between the cutting station (18) and a conveyor (27) for cut product, said first stops and said second stops being moveable perpendicular to the direction of travel of the conveyor.

2. The three knife cutting machine defined in claim 1 wherein, said second stops (24, 25) are oriented toward the front side of said stacked paper, and said machine further comprises third stops (23, 26, 29, 30) located at said cutting station, two of which (29, 30) are oriented toward the back side of said stacked paper, one of which (23) is oriented toward the head and one of which (26) is oriented toward the foot of said stacked paper.

3. The three knife cutting machine defined in claim 2 wherein, said head oriented stop (23) abuts one of said back oriented stops (29) and said foot oriented stop (26) abuts the remaining back oriented stop (30).

4. The three knife cutting machine defined in claim 3 wherein, said second stops and said third stops are mounted on two spaced-apart common carriers, and said carriers are moveable in opposing directions and at right angles to said direction of movement of said conveyor.

5. The three knife cutting machine as defined in claim 1 wherein, said pushers (7) move faster than said carriers until said stacked paper is delivered to a position against said first stops, whereupon said pushers move at the same rate as said carriers until said stacked paper reaches said cutting station.

* * * * *